US005755169A

United States Patent [19]

Hori et al.

[11] Patent Number: 5,755,169

[45] Date of Patent: May 26, 1998

[54] THREAD CUTTING APPARATUS

[75] Inventors: Masayuki Hori, Gifu; Hiroshi Yamasaki, Nagoya, both of Japan

[73] Assignee: Brother Kogyo Kabushiki Kaisha, Nagoya, Japan

[21] Appl. No.: 730,664

[22] Filed: Oct. 11, 1996

[30] Foreign Application Priority Data

Oct. 18, 1995 [JP] Japan ..... 7-270071

[51] Int. Cl.[6] ..... D05B 65/00

[52] U.S. Cl. ..... 112/291

[58] Field of Search ..... 112/285, 288, 112/291, 292, 293, 295, 296, 298

[56] References Cited

U.S. PATENT DOCUMENTS

| | | | |
|---|---|---|---|
| 4,365,568 | 12/1982 | Ross | 112/291 |
| 5,370,073 | 12/1994 | Hayashi | 112/291 |
| 5,372,079 | 12/1994 | Kitai et al. | 112/291 |
| 5,477,795 | 12/1995 | Nakayama et al. | 112/291 X |

FOREIGN PATENT DOCUMENTS

Y-2-2-14779 4/1990 Japan .

*Primary Examiner*—Paul C. Lewis

*Attorney, Agent, or Firm*—Oliff & Berridge, P.L.C.

[57] ABSTRACT

A thread cutting apparatus including a pair of blades one movable relative to the other to cut a thread, an actuating device including a cam rotatable about an axis line, and a cam follower which is movable to an operative position where the cam follower follows the cam to move the movable blade to cut the thread, and an inoperative position where the cam follower does not follow the cam, a biasing device which provides a biasing force to bias the cam follower toward the inoperative position, a first movable member which is operatively engaged with the cam follower and which is movable to a first position, and a second position to move the cam follower to the operative position against the biasing force of the biasing device, a second movable member which is movable between a third and a fourth position and which engages, when being moved from the third position to the fourth position, the first movable member to move the first movable member to the second position, and a rotary member which is rotatable with the cam and which holds the first movable member at the second position, against the biasing force of the biasing device, after the second movable member is moved from the fourth position to the third position, the rotary member permitting the first movable member to be moved to the first position, owing to the biasing force of the biasing device, after the movable blade is moved to cut the thread.

23 Claims, 12 Drawing Sheets

THREAD CUTTING APPARATUS

BACKGROUND OF THE INVENTION

1. Field of the Invention

The present invention relates to a thread cutting apparatus for use with, in particular, a sewing machine which includes a stitch forming device and a work-sheet feeding device and which forms stitches on the work sheet by means of relative movements of the stitch forming device and the work-sheet feeding device.

2. Related Art Statement

There is known a thread cutting apparatus which is employed in a sewing machine and which includes a thread-cutting control cam fixed to a lower shaft of the sewing machine and a blade moving mechanism which cooperates with the control cam to move a blade to cut a sewing thread or threads. In the prior thread cutting apparatus, the control cam and the moving mechanism are disconnectably connectable to each other. The prior apparatus additionally includes an exclusive operable member or an exclusive drive device for connecting the blade moving device to the control cam via an exclusive connecting device or transmission mechanism. The exclusive drive device may be provided by a solenoid and a control circuit for the solenoid, and the exclusive transmission mechanism may be provided by a link mechanism. Those exclusive drive device and transmission mechanism are provided in addition to the other mechanisms of the sewing machine, such as a shuttle, shuttle drive device, bobbin-thread take-up, work-sheet feeding device, etc.

However, since the prior thread cutting apparatus needs the exclusive solenoid, solenoid control circuit, transmission mechanism, etc. for cutting the sewing threads, the employment of the cutting apparatus in the sewing machine results in increasing the size of the sewing machine, increasing the total number of parts used in the same, and increasing the production cost of the same. In addition, the employment of those exclusive mechanisms for the thread cutting function leads to lowering the degree of freedom of the designing of the other mechanisms of the sewing machine by limiting, e.g., the sizes, spaces, and/or movable ranges thereof or therefor.

Japanese Patent Application laid open for opposition under Publication No. 2(1990)-14779 discloses a thread cutting apparatus which utilizes a drive source provided primarily for feeding a work sheet, secondarily for connecting a blade moving device to a thread-cutting control cam. However, this apparatus also suffers from the disadvantage of a very complex construction.

SUMMARY OF THE INVENTION

It is therefore an object of the present invention to provide a thread cutting apparatus which enjoys a simple construction, thereby contributing to improving the freedom of designing of, e.g., a sewing machine with which the thread cutting apparatus is used.

The above object has been achieved by the present invention. According to a first aspect of the present invention, there is provided a thread cutting apparatus comprising a pair of blades at least one of which is movable relative to the other blade to cut a thread, a movable-blade actuating device including a thread-cutting control cam which is rotatable about an axis line, and a cam follower which is movable to an operative position thereof where the cam follower follows the control cam to move the movable blade to cut the thread, and an inoperative position thereof where the cam follower does not follow the control cam, a biasing device which provides a biasing force to bias the cam follower toward the inoperative position, a first movable member which is operatively engaged with the cam follower and which is movable to a first position thereof, and a second position thereof to move the cam follower to the operative position against the biasing force of the biasing device, a second movable member which is movable between a third and a fourth position thereof and which engages, when being moved from the third position to the fourth position, the first movable member to move the first movable member to the second position, and a rotary member which is rotatable with the control cam and which holds the first movable member at the second position, against the biasing force of the biasing device, after the second movable member is moved from the fourth position to the third position, the rotary member permitting the first movable member to be moved to the first position, owing to the biasing force of the biasing device, after the control cam is rotated, the cam follower follows the rotation of the cam, and the movable blade is moved to cut the thread.

In the thread cutting apparatus in accordance with the first aspect of the invention, the thread-cutting control cam and the rotary member are rotatable with each other. When the control cam is rotated and the cam follower follows the rotation of the cam, the rotary member is also rotated while holding the first movable member at the second position, and the movable blade is moved to cut the thread. Thus, the present thread cutting apparatus enjoys a simple construction. The biasing device may indirectly apply the biasing force to the first movable member via the cam follower, or may otherwise apply directly the biasing force to the first movable member.

According to a preferred feature of the first aspect of the invention, the thread-cutting control cam and the rotary member are provided by a single rotatable member which is rotatable about the axis line. In this case, the thread cutting apparatus enjoys a very simple construction.

According to another feature of the first aspect of the invention, the thread-cutting control cam comprises a cylindrical cam having a cam groove formed in an outer circumferential surface thereof. In this case, the cam follower may forcedly be rotated about an axis line perpendicular to the axis line of the control cam. For example, in the case where the control cam is fixed to a lower shaft of a sewing machine, the cam is rotated with the lower shaft, i.e., rotated about a horizontal axis line. In the latter case, the cam follower may be rotated about a vertical axis line, in a plane parallel to a horizontal top surface of a sewing bed of the sewing machine. The thread can be cut with reliability by forcively rotating the cam follower.

According to another feature of the first aspect of the invention, the rotary member includes a cylindrical base portion whose center line coincides with the axis line, and an annular rib which projects concentrically from one end of the base portion and which has a recess extending in a circumferential direction of the annular rib, the rotary member holding the first movable member at the second position where a first portion of the first movable member is supported on an outer circumferential surface of the annular rib, the recess permitting the first movable member to be moved therethrough to the first position where the first portion of the first movable member is positioned inside the annular rib, owing to the biasing force of the biasing device. The employment of the rotary member having the annular rib and the recess contributes to reducing the production cost of the present apparatus.

According to another feature of the first aspect of the invention, the thread cutting apparatus is used with a sewing machine including an upper shaft, and a lower shaft for rotating a shuttle, and the thread-cutting control cam and the rotary member are fixed to the lower shaft of the sewing machine. In this case, the lower shaft primarily provided for driving the shuttle is secondarily used as means for supplying energy to cut the thread. Thus, the construction of the thread cutting apparatus is simplified.

According to another feature of the first aspect of the invention, the thread cutting apparatus is used with a sewing machine including a feeding member for feeding a work sheet, and the second movable member comprises the feeding member, the third position of the second movable member being in a normal range in which the feeding member is movable to feed the work sheet during a stitch-forming operation of the sewing machine, the fourth position of the second movable member being outside the normal range. Since the work-sheet feeding member is provided in the vicinity of the movable blade, the utilization of the feeding member as the second movable member contributes to reducing the size of the present apparatus.

According to another feature of the first aspect of the invention, the first movable member comprises a rotatable member which is rotatable about an axis line thereof to each of the first and second positions. Although the first movable member may be provided by a linearly movable member, a rotatable member can more easily be produced as the first movable member.

According to another feature of the first aspect of the invention, the rotatable member includes three arm portions which project radially from the axis line thereof and one of which is operatively engaged with the cam follower and the other two of which are engageable with the second movable member and the rotary member, respectively. In this case, the single rotatable member can operatively connect the cam follower to both the second movable member and the rotary member, thereby simplifying the construction of the thread cutting apparatus.

According to another feature of the first aspect of the invention, the thread cutting apparatus further comprises a support member which supports the cam follower such that the cam follower is movable along, and rotatable about, an axis line of the support member, and the cam follower is moved to the operative position along the axis line thereof and is rotated at the operative position about the axis line of the support member to move the movable blade to cut the thread. In this case, the construction of the thread cutting apparatus is simplified.

According to another feature of the first aspect of the invention, the thread cutting apparatus further comprises a support member which supports the cam follower such that the cam follower is movable along, and rotatable about, an axis line of the support member which is substantially perpendicular to the axis line of the thread-cutting control cam, wherein the cam follower is moved to the operative position along the axis line of the support member and is rotated at the operative position about the axis line to move the movable blade to cut the thread, and wherein the first movable member comprises a rotatable member which is rotatable, to each of the first and second positions, about an axis line thereof which is substantially perpendicular to the axis line of the support member. In this case, the thread cutting apparatus enjoys a simplified construction.

According to another feature of the first aspect of the invention, the cam follower includes a pair of engagement portions which are spaced apart from each other in a direction parallel to the axis line of the support member, and the rotatable member includes an engagement arm whose end portion is sandwiched between the pair of engagement portions of the cam follower such that the rotation of the rotatable member and the axial movement and rotation of the cam follower are permitted. In this case, the cam follower and the rotatable member that are rotatable about the respective axis lines substantially perpendicular to each other, are held in engagement with each other in a simple and stable fashion.

According to another feature of the first aspect of the invention, the movable blade comprises a reciprocating blade which reciprocates along a straight line.

According to another feature of the first aspect of the invention, the thread cutting apparatus further comprises a support member which supports the cam follower such that the cam follower is movable along, and rotatable about, an axis line of the support member which is substantially perpendicular to the axis line of the thread-cutting control cam, wherein the movable-blade actuating device comprises an intermediate lever which is rotatable about, and immovable along, an axis line thereof parallel to the axis line of the support member, and which is engaged with the cam follower and the movable blade, and wherein when the cam follower is rotated, the intermediate lever reciprocates the movable blade along the straight line. In this case, the movable-blade actuating device enjoys a simple construction.

According to another feature of the first aspect of the invention, the movable-blade actuating device comprises a spring member which provides a biasing force to hold the movable blade at an inoperative position thereof and which permits the movable blade to be moved thereagainst by the thread-cutting cam and the cam follower so as to cut the thread.

According to another feature of the first aspect of the invention, the thread cutting apparatus further comprises an input device which is operable to input an electric thread-cutting command, and a control device which is operable, in response to the thread-cutting command, for moving the second movable member from the third position to the fourth position.

According to another feature of the first aspect of the invention, the thread cutting apparatus is used with a sewing machine including a feeding member for feeding a work sheet and a feeding-pitch adjusting member whose inclination angle is changeable within a normal range for adjusting a work-sheet feeding pitch of the feeding member, and the thread-cutting apparatus further comprises a control device which inclines the adjusting member by an angle beyond the normal range so that the second movable member is moved from the third position to the fourth position and the thread is cut by the pair of blades.

According to another feature of the first aspect of the invention, the thread cutting apparatus is used with a sewing machine including a feeding member for feeding a work sheet and a feeding-pitch adjusting member whose inclination angle is changeable within a normal range for adjusting a work-sheet feeding pitch of the feeding member, and the thread-cutting apparatus further comprises an input device which is operable to input an electric thread-cutting command, and a control device which is operable, in response to the thread-cutting command, for inclining the adjusting member by an angle beyond the normal range so that the second movable member is moved from the third position to the fourth position.

According to a second aspect of the present invention, there is provided a thread cutting apparatus comprising a pair of blades at least one of which is movable relative to the other blade to cut a thread, a movable-blade actuating device including a thread-cutting control cam which is rotatable about a first axis line, and a cam follower which is movable to an operative position thereof where the cam follower follows the control cam to move the movable blade to cut the thread, and an inoperative position thereof where the cam follower does not follow the control cam, the cam follower being movable along, and rotatable about, a second axis line, the cam follower being moved to the operative position along the second axis line and rotated at the operative position about the second axis line to move the movable blade to cut the thread, a biasing device which provides a biasing force to bias the cam follower toward the inoperative position, a first movable member which is operatively engaged with the cam follower and which is movable to a first position thereof, and a second position thereof to move the cam follower to the operative position against the biasing force of the biasing device, a second movable member which is movable between a third and a fourth position thereof and which engages, when being moved from the third position to the fourth position, the first movable member to move the first movable member to the second position, and a holding device which holds the first movable member at the second position, against the biasing force of the biasing device, after the second movable member is moved from the fourth position to the third position, the holding device permitting the first movable member to be moved to the first position, owing to the biasing force of the biasing device, after the control cam is rotated, the cam follower follows the rotation of the cam, and the movable blade is moved to cut the thread.

In the thread cutting apparatus in accordance with the second aspect of the invention, the cam follower can be moved along, and rotated about, the second axis line, so that the cam follower can be moved to the operative position along the second axis line and rotated at the operative position about the second axis line to move the movable blade to cut the thread. Thus, the thread cutting apparatus enjoys a simple construction. The cam follower may be moved relative to a support member, such as a shaft member, which defines the second axis line, or otherwise may be moved with the support member along the second axis line. Similarly, the cam follower may be rotated about the support member defining the second axis line, or otherwise may be rotated with the support member about the second axis line.

According to a preferred feature of the second aspect of the invention, the thread cutting apparatus further comprises a support member which supports the cam follower such that the cam follower is movable along, and rotatable about, the second axis line which is substantially perpendicular to the first axis line of the thread-cutting control cam.

According to another feature of the second aspect of the invention, the movable-blade actuating device comprises an intermediate lever which is rotatable about, and immovable along, a third axis line parallel to the second axis line of the support member and which is engaged with the cam follower and the movable blade, and wherein when the cam follower is rotated, the intermediate lever moves the movable blade to cut the thread. In this case, the movable-blade actuating device enjoys a simplified construction.

According to another feature of the second aspect of the invention, one of the cam follower and the intermediate lever includes an engagement projection which projects substantially parallel to the second axis line and the other of the cam follower and the lever includes an engagement recess which is engaged with the engagement projection irrespective of which one of the operative and inoperative positions is taken by the cam follower, the rotation of the cam follower about the second axis line being transmitted to the intermediate lever via the engaged projection and recess. In this case, even if the cam follower may be moved between the operative and inoperative positions, the cam follower and the intermediate lever are easily held in engagement with each other.

According to a third aspect of the present invention, there is provided a thread cutting apparatus for use with a sewing machine including an operable member which is operable within a normal range to control an operation of the sewing machine, the apparatus comprising, a pair of blades at least one of which is movable relative to the other blade to cut a thread, a movable-blade actuating device including a thread-cutting control cam which is rotatable about an axis line, and a cam follower which is movable to an operative position thereof where the cam follower follows the control cam to move the movable blade to cut the thread, and an inoperative position thereof where the cam follower does not follow the control cam, and a connecting device which operatively connects the operable member with the cam follower such that when the operable member is operated to a special position outside the normal range, the cam follower is moved to the operative position.

In the thread cutting apparatus in accordance with the third aspect of the invention, when the operable member is operated to the special position outside or beyond the normal range, the cam follower is moved to the operative position, so that the movable blade is moved to cut the thread. The connecting device may comprise a known device such as a zero-max link mechanism.

According to a preferred feature of the third aspect of the invention, the thread cutting apparatus further comprises a biasing device which produces a biasing force to bias the cam follower toward the inoperative position, and a holding device which holds the cam follower at the operative position, against the biasing force of the biasing device, after the operable member is moved to a position within the normal range, the holding device permitting the cam follower to be moved to the inoperative position, owing to the biasing force of the biasing device, after the control cam is rotated, the cam follower follows the rotation of the cam, and the movable blade is moved to cut the thread. In this case, the holding device holds the cam follower at the operative position, against the biasing force of the biasing device, even after the operable member has been moved to a position within the normal range, and permits the cam follower to be moved to the inoperative position, owing to the biasing force of the biasing device, after the movable blade has been moved to cut the thread. Therefore, the present thread cutting apparatus enjoys a better operability than an apparatus wherein an operable member must be held at a special position outside a normal operation range throughout each thread cutting operation and must be returned to a position inside the normal range after the thread cutting operation.

BRIEF DESCRIPTION OF THE DRAWINGS

The above and optional objects, features, and advantages of the present invention will better be understood by reading the following detailed description of the preferred embodiments of the invention when considered in conjunction with the accompanying drawings, in which.

DETAILED DESCRIPTION OF THE PREFERRED EMBODIMENTS

Referring first to FIGS. 1 to 10, there will be described a thread cutting apparatus for use with a sewing machine. The thread cutting apparatus embodies the present invention.

Figure 8:
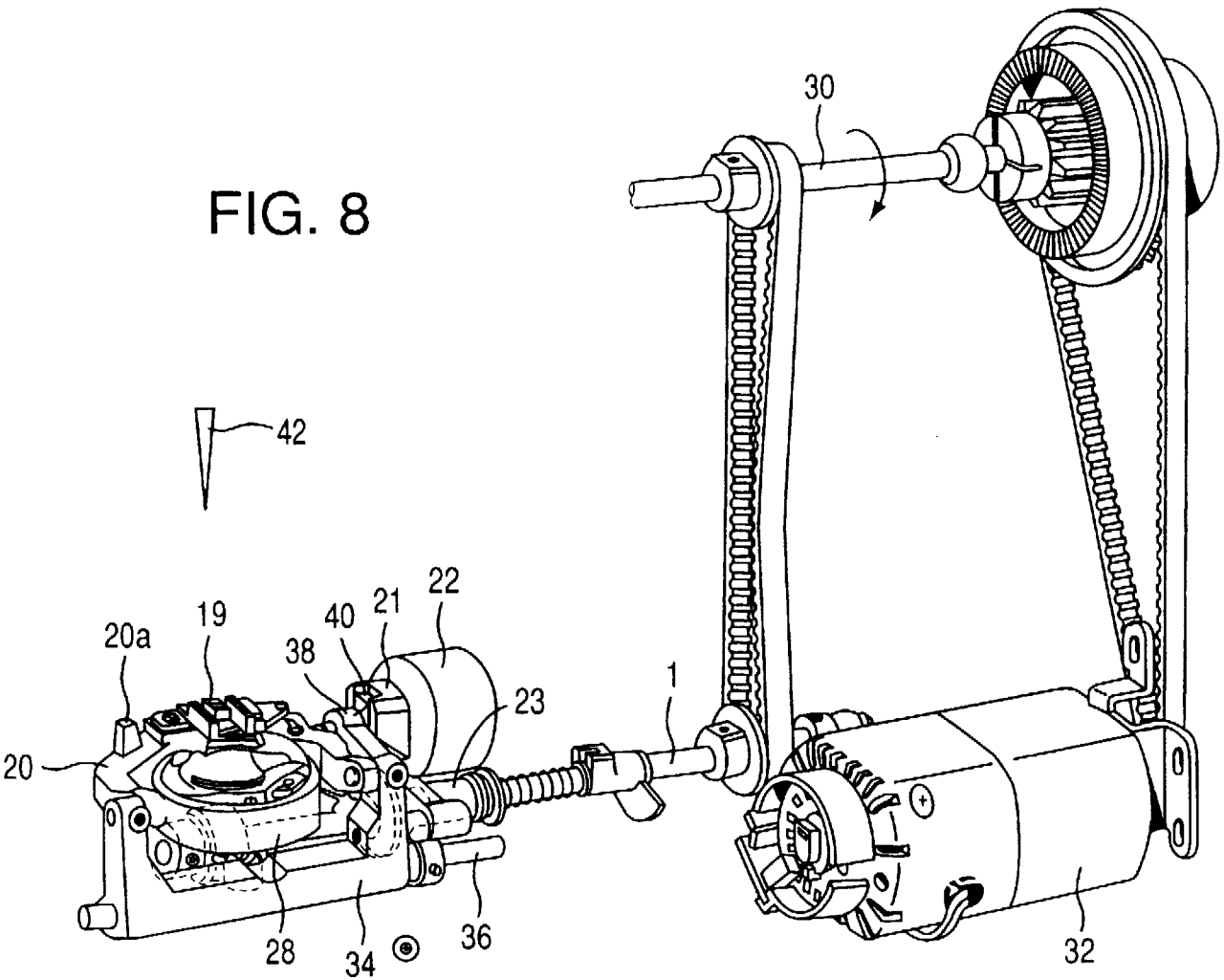
FIG. 8 is a perspective view of a stitch forming device and a work-sheet feeding device of the sewing machine with which the apparatus of FIG. 1 is used.

As shown in FIGS. 1 to 4, the thread cutting apparatus includes a thread-cutting cylindrical control cam 2 fixed to an end of a lower shaft 1 of the sewing machine that extends in a right and a left direction of the sewing machine. The lower shaft 1 is rotated with an upper shaft 30 to which a sewing needle 42 is connected via a needle bar (not shown), as shown in FIG. 8. A thread cutting unit 3 is disposed above the control cam 2 with which the unit 3 cooperates to provide a movable-blade actuating device. The cutting unit 3 includes a thread-cutting frame 4 fixed to a main frame (not shown) of the sewing machine. A movable mess or blade 5 is supported by the frame 4 such that the movable blade 5 can be reciprocated by being guided in a straight groove 4*a* extending parallel to the lower shaft 1. A fixed blade 6 is fixed to the frame 4 and cooperates with the movable blade 5 to cut a needle thread conveyed by the needle 42 and a bobbin thread supplied from a bobbin (not shown) accommodated in a shuttle 28 (FIG. 8).

A first support shaft 7 which extends in a direction substantially perpendicular to the lower shaft 1 is fixed to a portion of the frame 4, and a first link 8 is supported by the first support shaft 7 such that the first link 8 is rotatable about the shaft 7 but is immovable in an axial direction of the shaft 7. The first link 8 provides a lever having a first elongate hole 8*a* which is rotatably engaged with a first pin 5*a* fixed to the movable blade 5 to reciprocate the blade 5 to cut the sewing threads. A second pin 5*b* fixed to the movable blade 5 is engaged with the guide groove 4*a* of the frame 4. A second support shaft 9 which extends parallel to the first support shaft 7 is fixed to another portion of the frame 4, and a second link 10 is supported by the second support shaft 9 such that the second link 10 is rotatable about the shaft 9 and is movable in an axial direction of the shaft 9. A torsion spring 11 produces a biasing force to bias, via the first link 8, the movable blade 5 toward a retracted or inoperative position thereof where the movable blade 5 cannot cooperate with the fixed blade 6 to cut the sewing threads. However, the movable blade 5 can be moved along the guide groove 4*a* to an advanced or operative position thereof where the blade 5 cooperates with the fixed blade 6 to cut the threads. A compression spring 12 produces a biasing force to bias the second link 10 toward an inoperative position thereof where an engagement pin 16 fixed to the second link 10 cannot engage a cam groove 2*b* of the control cam 2. However, the second link 10 can be moved, against the biasing force of the compression spring 12, relative to the second shaft 9 to an operative position thereof where the pin 16 can engage the cam groove 2*b*. The first link 8 has a second elongate hole 8*b*, and the second link 10 has an engagement projection 10*a* which is engaged with the elongate hole 8*a* irrespective of which position is being taken by the second link 10 relative to the second shaft 9.

A third support shaft 17 which extends parallel to the lower shaft 1 is fixed to the frame 4, and a thread-cutting switch member 18 is supported by the third shaft 17 such that the switch member 18 is rotatable about the shaft 17 and is immovable in an axial direction of the shaft 17. The switch member 18 has three arms which extend radially outwardly from an axis line of the third shaft 17.

Figure 1:
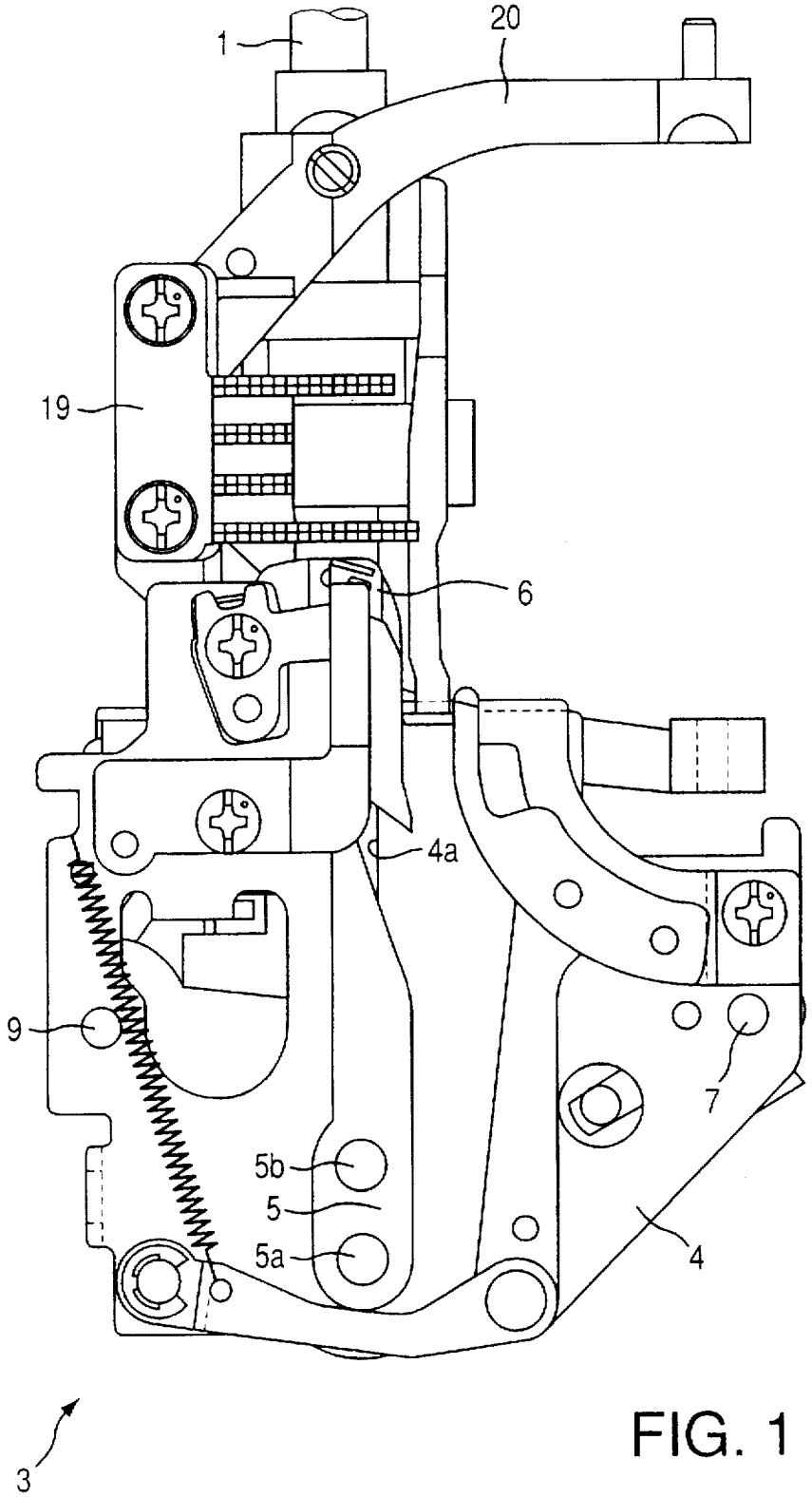
FIG. 1 is a plan view of a thread cutting apparatus embodying the present invention, the apparatus being in a state in which a stitch forming operation is carried out on a sewing machine.
Figure 2:
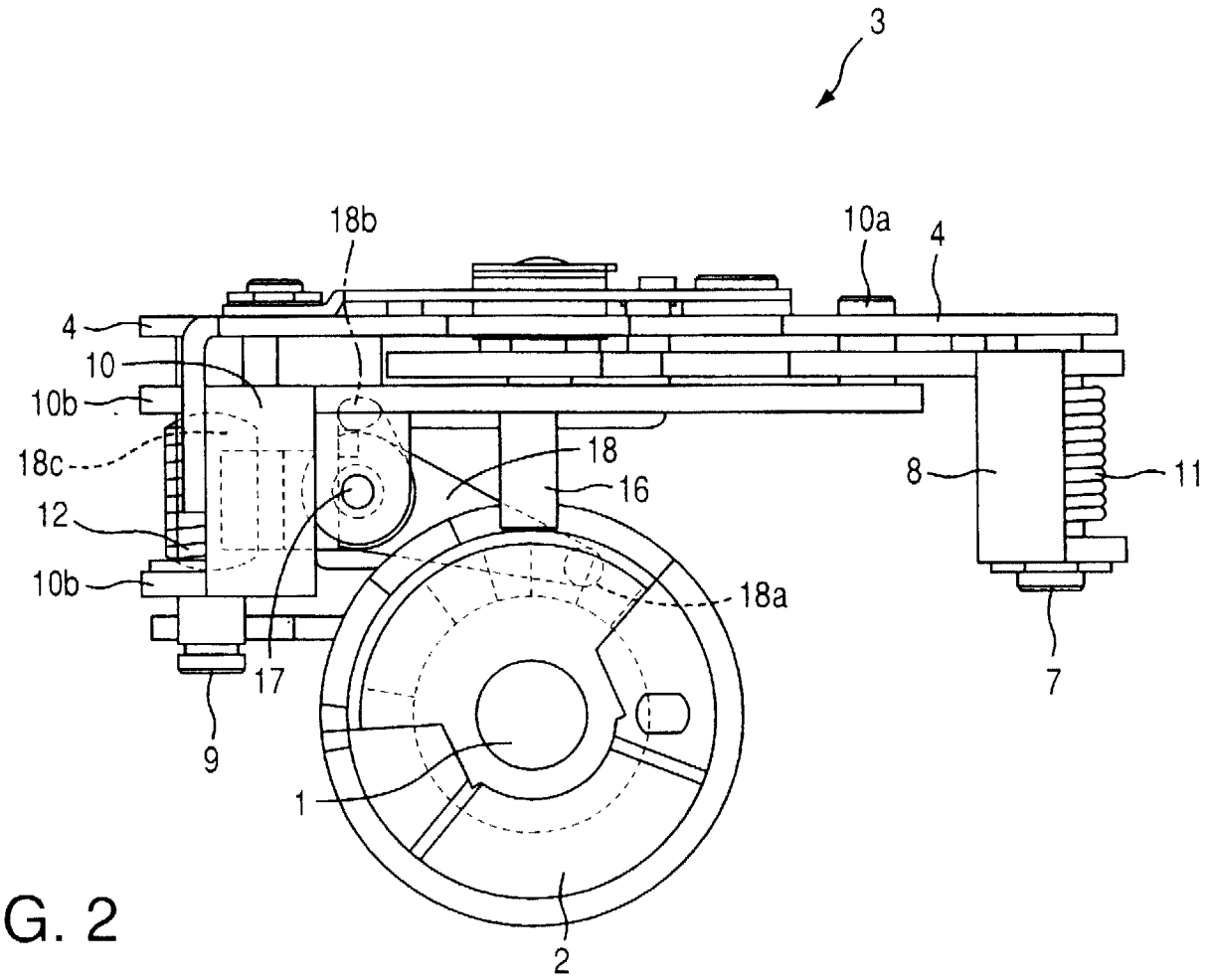
FIG. 2 is a side view of the apparatus of FIG. 1.
Figure 3:
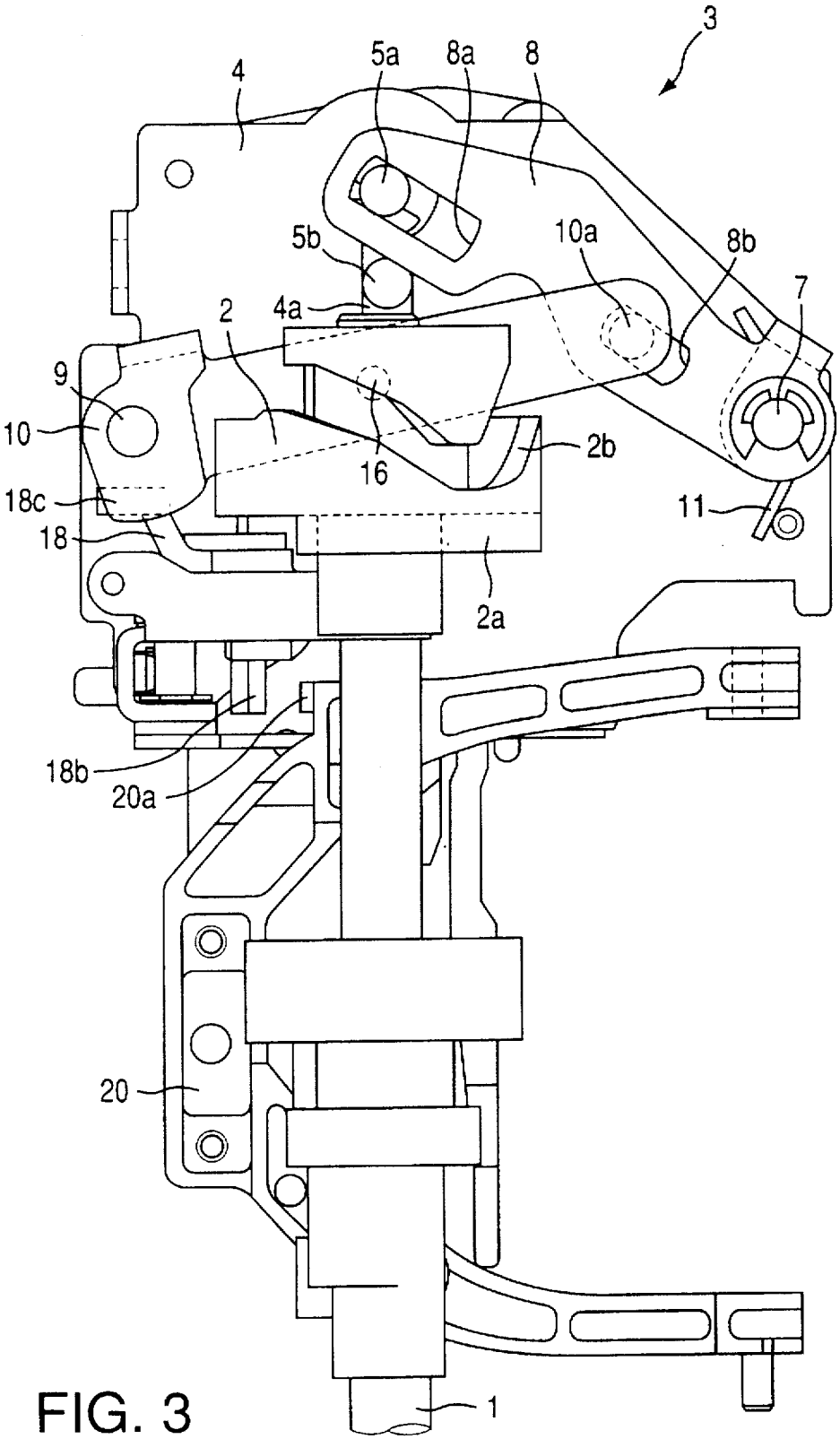
FIG. 3 is a bottom view of the apparatus of FIG. 1.
Figure 4:
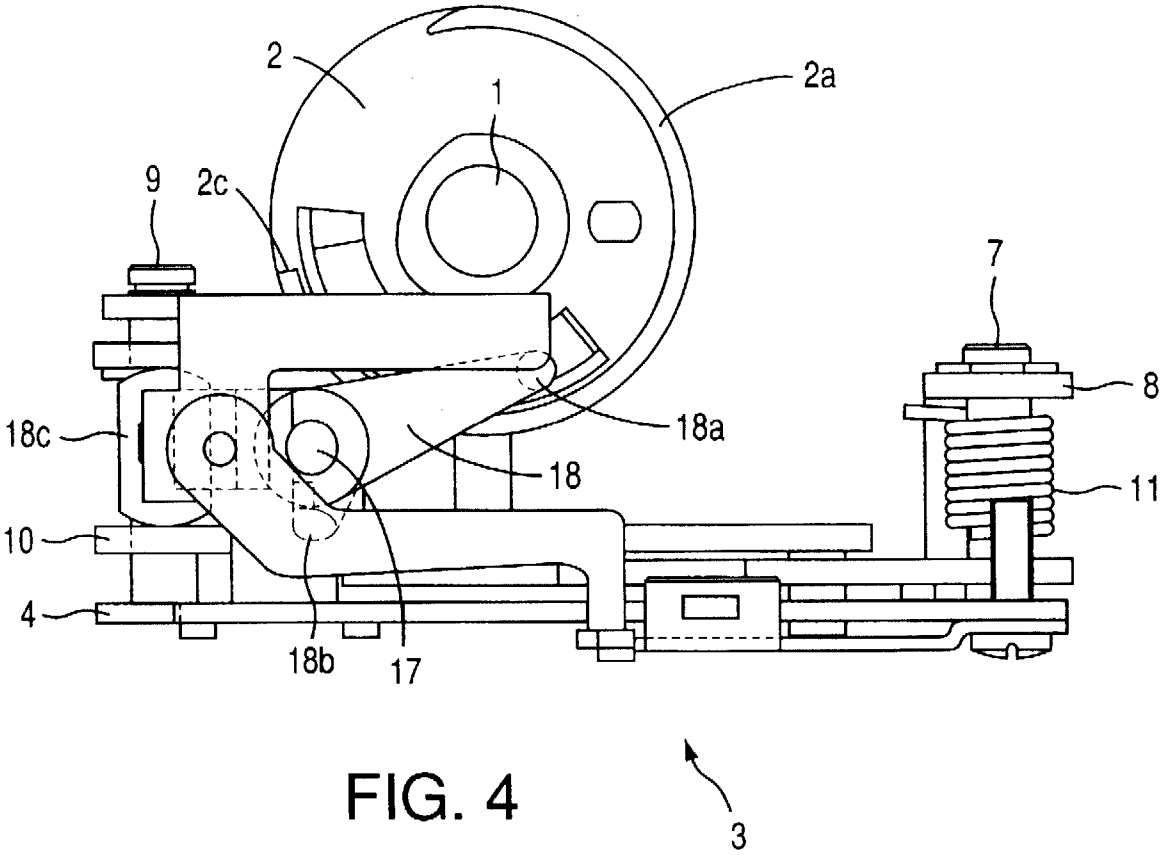
FIG. 4 is an inverted side view of the apparatus of FIG. 1, with a thread-cutting unit thereof being partially cut away.
Figure 9:
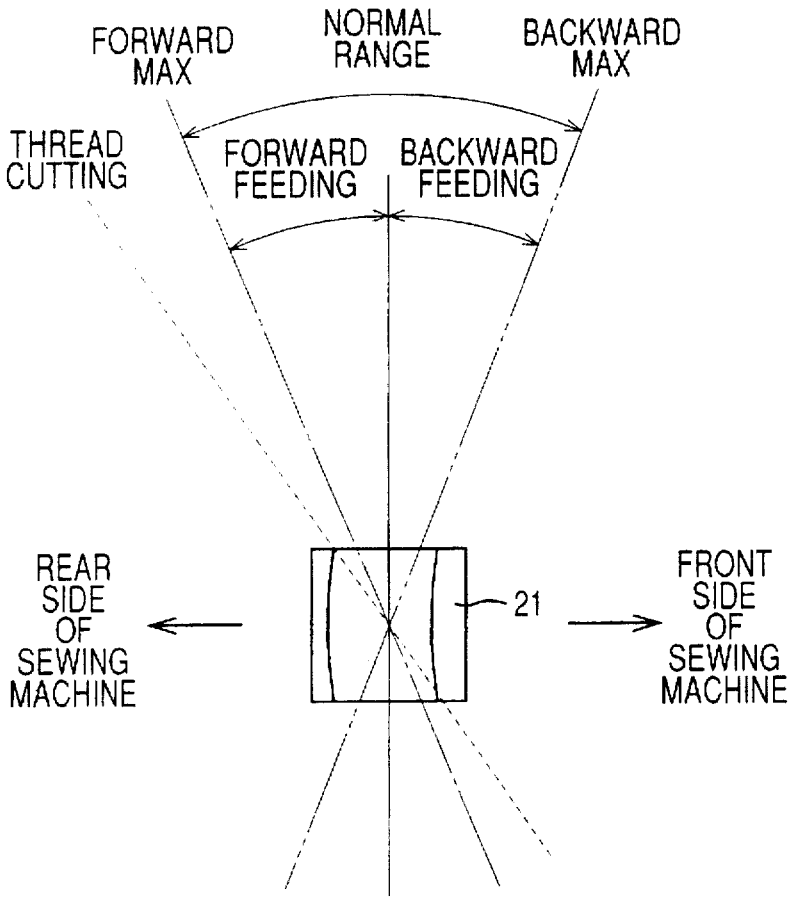
FIG. 9 is a view for illustrating the manner in which a work-sheet feed pitch adjuster 21 of the sewing machine is inclined.
Figure 10:
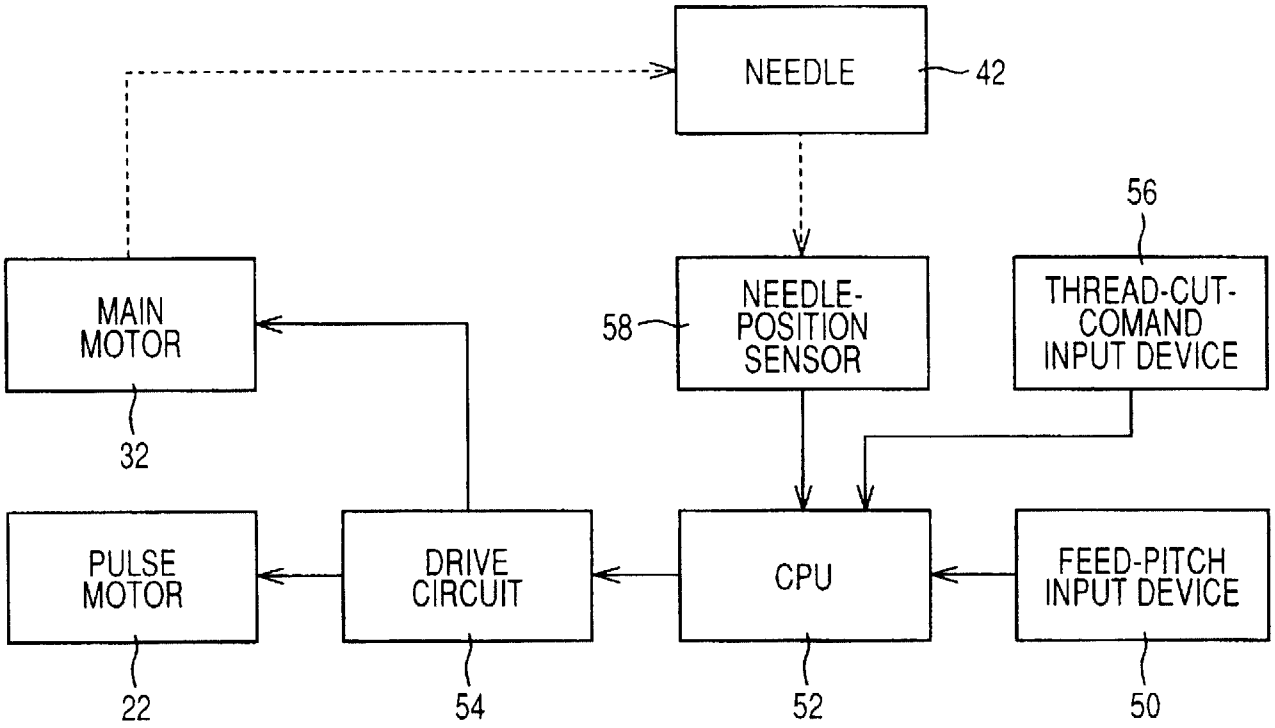
FIG. 10 is an electric arrangement of the sewing machine.

The first arm of the switch member 18 extends in a frontward and downward direction of the sewing machine and has a circular boss 18*a* projecting parallel to the lower shaft 1. During a stitch forming operation of the sewing machine, the circular boss 18*a* is positioned radially inwardly of an annular rib 2*a* which projects concentrically from the control cam 2 in a direction parallel to the lower shaft 1. As shown in FIG. 4, the annular rib 2*a* has a recess 2*c* extending in a circumferential direction of the cam 2 over a length which enables the circular boss 18*a* to pass therethrough. The second arm 18*b* of the switch member 18 extends in an upward direction of the sewing machine and a top portion thereof is positioned in a route in which a projection 20*a* of a work-sheet feeder 20 to which a feed dog 19 is fixed is moved. The position of the second arm 18*b* is outside a forward-direction maximum feed amount or limit of a normal range within which the feeder projection 20*a* can be moved during the stitch forming operation of the sewing machine. Therefore, during the stitch forming operation of the sewing machine, the second arm 18*b* and the feeder projection 20*a* cannot engage each other even in the case where a forward-direction maximum feed pitch (indicated at "FORWARD MAX" in FIG. 9) may be selected by an operator through a feed-pitch input device 50 (FIG. 10).

The third arm of the switch member 18 extends in a rearward direction of the sewing machine and includes an end portion 18*c* having an upper and a lower curved (i.e., part-cylindrical) surface. The end portion 18*c* is sandwiched between an upper and a lower base portion 10*b*, 10*b* of the second link 10 via which the second link 10 can be rotated about the second shaft 9. The end portion 18*c* is engaged with the two base portions 10*b*, 10*b* such that the rotation of the switch member 18 about the third shaft 17 is permitted and the rotation and axial movement of the second link 10 about and along the second shaft 9 are permitted. The biasing force of the compression spring 12 is applied to the third arm 18*c* of the switch member 18 via the second link 10, so that the first arm or circular boss 18*a* is positioned radially inwardly of the rib 2*a* of the cam 2. However, when the second arm 18*b* of the switch member 18 is pushed rearward by the feeder projection 20*a*, the switch member 18 is rotated about the third shaft 17 and the third arm 18*c* is moved downward against the biasing force of the spring 12, so that the circular boss 18*a* is moved upward to a position outside the rib 2*a* and the engagement pin 16 fixed to the second link 10 is moved downward to the operative position where the pin 16 can engage the cam groove 2*b* of the cam 2. Thus, when the thread-cutting switch member 18 is rotated by the movement of the feeder projection 20*a* beyond the normal range, the thread-cutting unit 3 and the thread-cutting control cam 2, i.e., the movable-blade actuating device is placed in an operative state in which the actuating device can reciprocate the movable blade 5 between the retracted and advanced positions to cut the sewing threads. The switch member 18 (18*a*, 18*b*, 18*c*) is integrally formed of a synthetic resin.

As shown in FIG. 8, the feed dog 19 which feeds a work sheet (not shown) such as a fabric or cloth sheet relative to the sewing needle 42, is provided above the shuttle 28 which cooperates with the needle 42 to form stitches on the work sheet. The feed dog 19 is fixed to an upper surface of the work-sheet feeding member or feeder 20 provided around the shuttle 28, and is movable forward and backward, and upward and downward, together with the feeder 20. The shuttle 28 is rotated by the lower shaft 1 which is rotated in synchronism with the rotation of the upper shaft 30 which reciprocates the needle 42 upward and downward. The upper shaft 30 is rotated or driven by a main motor 32. The upward projection 20*a* is integrally formed with a portion of the feeder 20 provided on a left-hand side of the dog 19.

An end portion of the feeder 20 which is remote from the feed dog 19 is rotatably supported by upper end portions of a feed arm 34. A lower end portion of the feed arm 34 is rotatably supported via a feed-arm shaft 36 by the main frame of the sewing machine. One end of a feed link 38 is connected to an intermediate portion of the feed arm 34, and a guided member 40 is rotatably connected to the other end of the feed link 38. The guided member 40 is movably engaged with a guide groove 42 formed in a feed-pitch adjusting member or adjuster 21, and the adjuster 21 is fixed to an output shaft of a pulse motor 22 fixed to the main frame of the sewing machine. The feed link 38 is moved by a horizontal-feed cam 23 fixed to the lower shaft 1, so that the feeder 20 or feed dog 19 is moved in a horizontal direction, i.e., a forward and a backward direction thereof respectively corresponding to a rearward and a frontward direction of the sewing machine. In addition, the feeder 20 or dog 19 is moved upward and downward by a vertical-feed cam (not shown).

The feeder 20, feed link 38, guided member 40, feed-pitch adjuster 21, feed arm 34, feed-arm shaft 36, etc. cooperate with one another to provide a known zero-max link mechanism wherein the work-sheet feed pitch, i.e., amount of movement of the feed dog 19 in the horizontal direction can be adjusted by changing the angle of inclination of the feed-pitch adjuster 21. As shown in FIG. 9, when a center line of the adjuster 21, indicated at solid line, extends vertically, that is, the adjuster 21 is positioned at zero degree, the feed pitch is zero, that is, the work sheet is not fed forward or backward. As the angle of inclination of the center line of the adjuster 21 increases toward the front side of the sewing machine, the backward-direction feed pitch increases up to a maximum or limit ("BACKWARD MAX") indicated at two-dot chain line. On the other hand, as the angle of inclination of the center line of the adjuster 21 increases toward the rear side of the sewing machine, the forward-direction feed pitch increases up to a maximum or limit ("FORWARD MAX") indicated at one-dot chain line. When the feed dog 19 is moved in the forward direction thereof, the work sheet is fed in the rearward direction of the sewing machine; and when the feed dog 19 is moved in the backward direction thereof, the work sheet is fed in the frontward direction of the sewing machine.

For a stitch forming operation, a work-sheet feed pitch is selected or input by the operator through the feed-pitch input device 50 shown in FIG. 10. In response to an output signal from the input device 50, a central processing unit (CPU) 52 of a computer as a control device controls a drive circuit 54 to drive the pulse motor 22 and thereby rotate the feed-pitch adjuster 21 within the normal angular range between the forward-direction and backward-direction maximum feed pitches shown in FIG. 9.

When the stitch forming operation ends, the operator may operate a thread-cut-command input device 56 which generates, in response thereto, a command signal which is supplied to the CPU 52 which controls, in response thereto, the drive circuit 54 to drive the pulse motor 22 so that the center line of the adjuster 21 is inclined to a special angular position, indicated at broken line in FIG. 9, outside the normal angular range. This special position cannot be established by operating the feed-pitch input device 50. Thus, the feeder 20 or projection 20*a* is placed in a state in which the projection 20*a* can be moved beyond the normal movement range thereof, i.e., forward-direction maximum feed pitch thereof, in the rearward direction of the sewing machine. A needle-position sensor 58 is connected to the CPU 50. The sensor 58 detects a phase or position of the sewing needle 42 and supplies a detection signal indicative of the detected needle position to the CPU 50.

Figure 11:
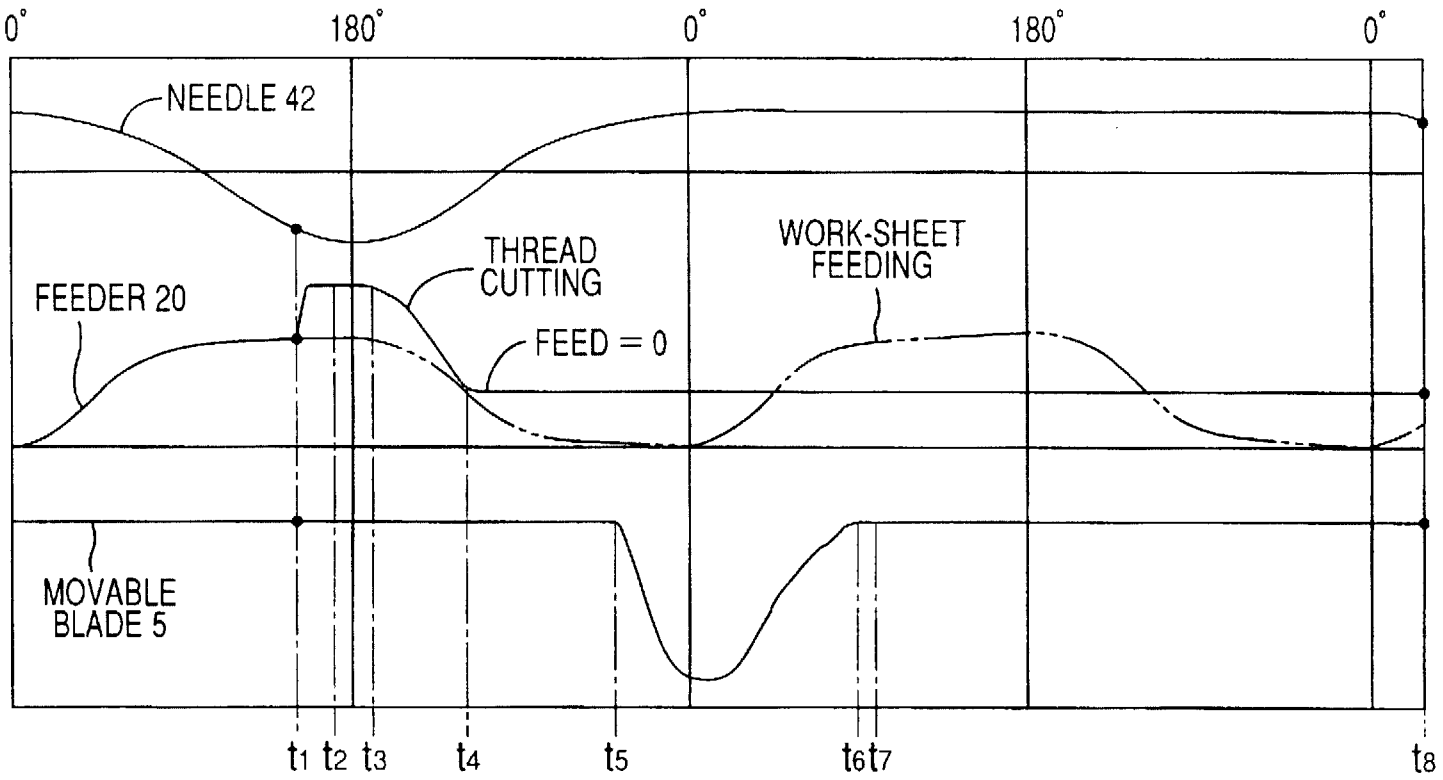
FIG. 11 is a time chart representing a thread cutting operation carried out on the sewing machine.

Next, there will be described the operation of the thread cutting apparatus constructed as described above, by reference to FIGS. 5, 6, and 7 and the time chart of FIG. 11.

When a stitch forming operation ends, the CPU 52 controls the main motor 32 to stop the sewing needle 42. Then, if a thread-cut command is input by the operator through the thread-cut-command input device 56, an electric command signal is supplied from the input device 56 to the CPU 52 which drives, at a time, $t_1$, shown in FIG. 11, the pulse motor 22 to rotate the feed-pitch adjuster 21 to the special position, indicated at broken line in FIG. 9, beyond the normal range, when the lower shaft 1 is rotated by the main motor 32 to a predetermined phase detected by the needle-position sensor 58. Thus, the feeder 20 is fed in the forward direction thereof (i.e., in the rearward direction of the sewing machine) beyond the forward-direction maximum feed pitch, and the projection 20*a* pushes the second arm 18*b* of the thread-cutting switch member 18 in the rearward direction. Consequently the third arm 18*c* of the switch member 18 is moved downward with the second link 10 against the biasing force of the compression spring 12 and the engagement pin 16 fixed to the link 10 is moved downward to the operative position thereof where the pin 16 can engage the cam groove 2*b* of the thread-cutting control cam 2. In this way, the switch member 18 is rotated because of the special inclination of the feed-pitch adjuster 21.

Figure 5:
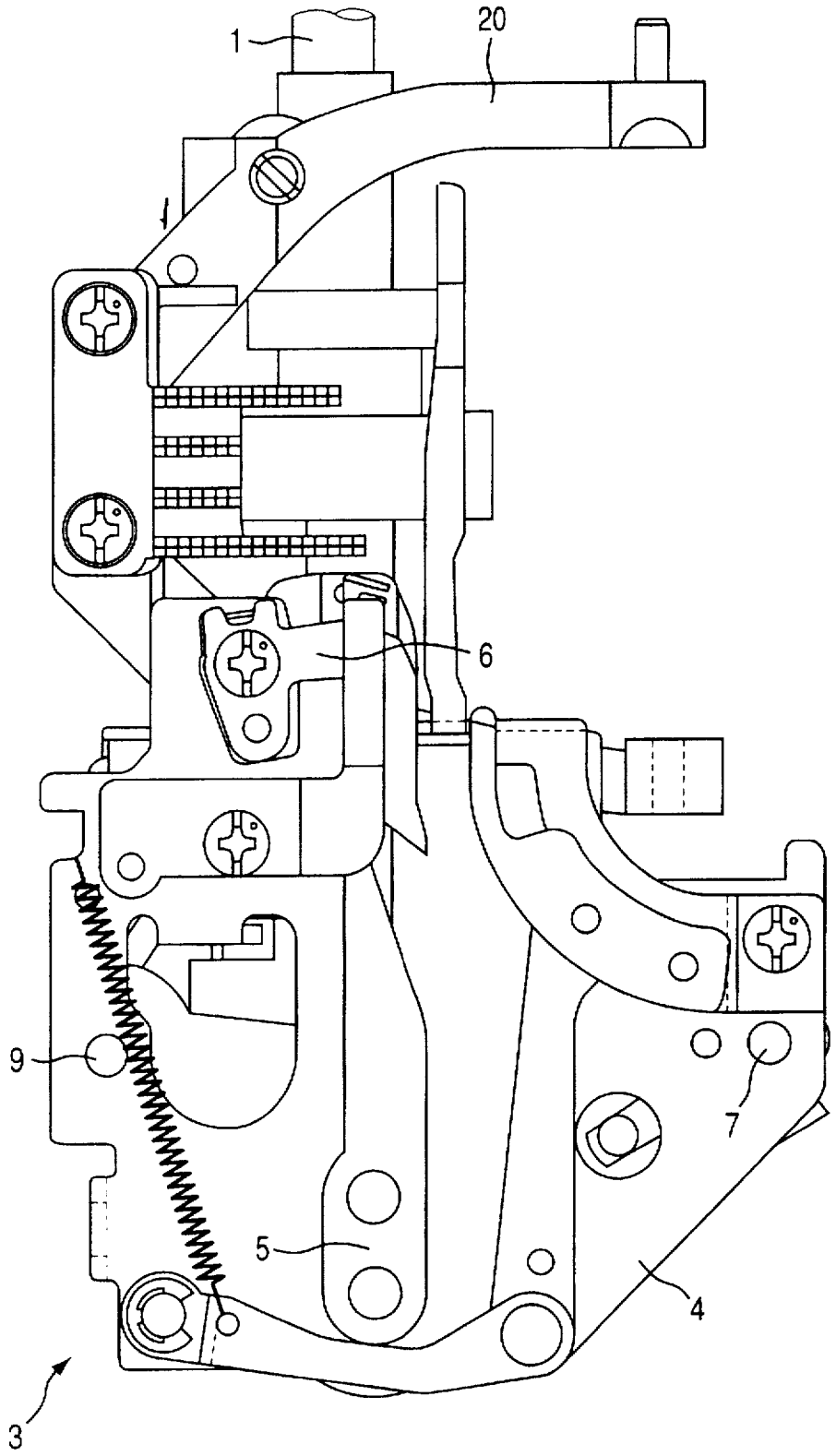
FIG. 5 is a plan view corresponding to FIG. 1, showing the apparatus of FIG. 1 in a state in which a thread cutting operation is carried out on the sewing machine.
Figure 6:
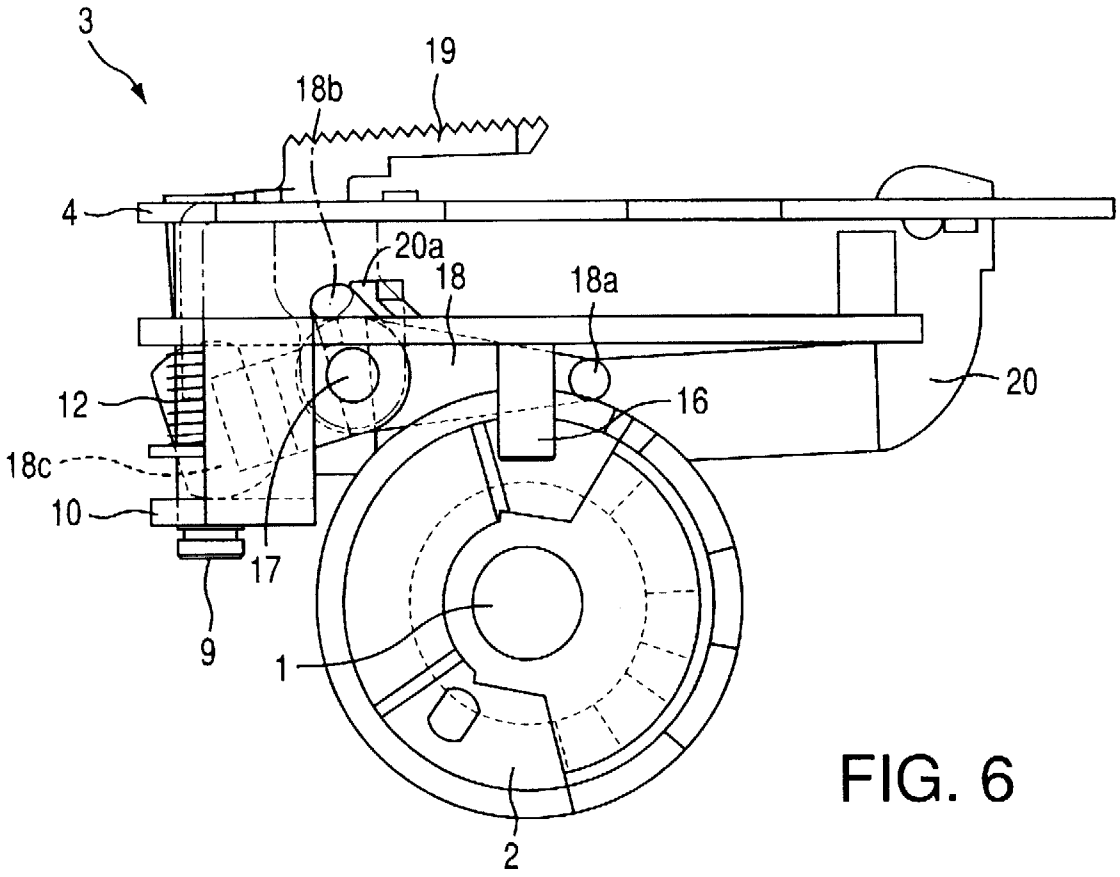
FIG. 6 is a side view corresponding to FIG. 2, showing the apparatus of FIG. 1 being in the state shown in FIG. 5.
Figure 7:
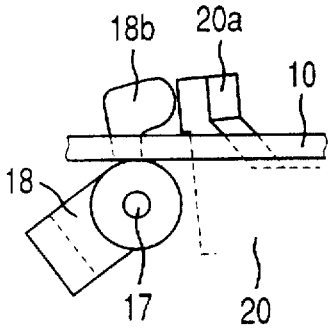
FIG. 7 is an enlarged view of a portion of the apparatus of FIG. 1.

In addition, since, at time $t_1$, the recess 2*c* of the annular rib 2*a* of the cam 2 is positioned right above the circular boss 18*a* of the first arm of the thread-cutting switch member 18, the boss 18*c* is moved upward through the recess 2*c* to a position radially outside the rib 2a. When the lower shaft 1 is rotated from this state, a portion of the rib 2a is moved to a position below the boss 18a, at a time, $t_2$, shown in FIG. 11. Subsequently, at a time, $t_3$, the feeder 20 starts moving in the frontward direction of the sewing machine, because of the rotation of the horizontal-feed cam 23, so that the feeder projection 20a is moved away from the second arm 18b of the switch member 18. However, since the circular boss 18b is supported on the annular rib 2a of the cam 2, the switch member 18 keeps the second link 10 such that the pin 16 is held in the state in which the pin 16 can engage the cam groove 2b, as shown in FIGS. 5 to 7. While the feeder 20 is moved in the frontward direction, the adjuster 21 is automatically returned, at a time, $t_4$, to the zero ("0") position.

As the lower shaft 1 is further rotated, the cam 2, pin 16, links 10, 8, etc. cooperate with one another to start, at a time, $t_5$, reciprocating the movable blade 5 to cut the sewing threads. After the thread cutting operation ends at a time, $t_6$, the recess 2c of the annular rib 2a is moved to a position below the circular boss 18a of the switch member 18, at a time, $t_7$, so that the third arm 18c of the switch member 18 is moved upward because of the biasing or elastic force of the compression spring 12 and the circular boss 18a is moved downward through the recess 2c. The thread-cutting operation of the sewing machine ends at a time, $t_8$. Thus, the thread-cutting switch member 18 is automatically switched from the thread-cutting position to the stitch-forming position. The movable blade 5 can be moved only while the switch member 18 is placed in the thread-cutting position.

As is apparent from the foregoing description, the thread-cutting switch member 18 is rotated by the feeder 20 (or projection 20a) as the work-sheet feeding device, so that the engagement pin 16 as a cam follower is moved to the operative position where the pin 16 can engage the cam groove 2b of the cam 2 and thereby move the movable blade 5 to cut the threads. Thus, the work-sheet feeding device 20, 20a is utilized as a drive source for moving the movable blade 5. In addition, the provision of the present thread cutting apparatus does not lower the degree of freedom of designing of the shuttle 28, the feed device 19, 20, etc. of the sewing machine. Since the present thread cutting apparatus does not need an exclusive drive source or control circuit, the employment of the apparatus contributes to reducing the size of the sewing machine and simplifying the construction of the same.

Since in the illustrated embodiment the projection 20a is provided on the conventional feeder 20 so that the projection 20a can engage and push the second arm 18b of the thread-cutting switch lever 18, the movable-blade actuating device 2, 3 is easily placed in the state in which the actuating device 2, 3 can actuate the movable blade 5 to cut the threads.

While the present invention has been described in its preferred embodiment, the present invention may otherwise be embodied.

Figure 12:
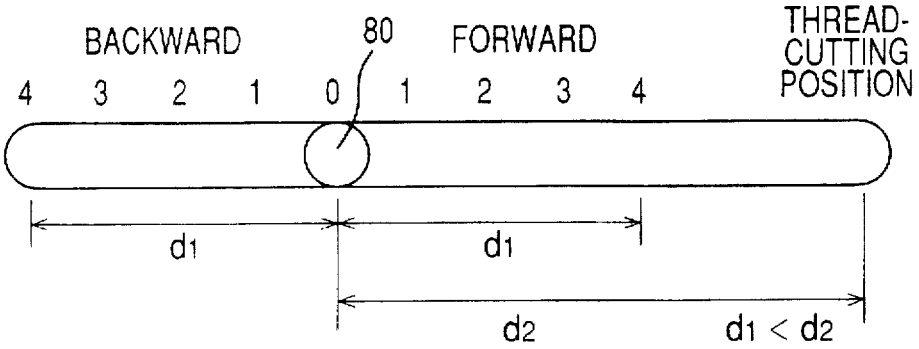
FIG. 12 is an illustrative view of a work-sheet feed pitch selecting device of another thread cutting apparatus as a second embodiment of the present invention.
Figure 13:
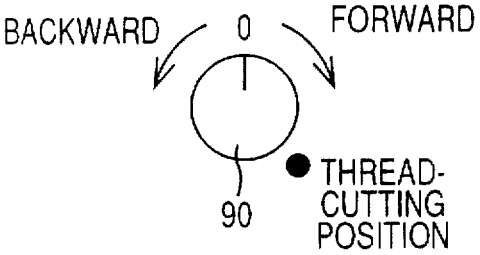
FIG. 13 is an illustrative view of a work-sheet feed pitch selecting device of yet another thread cutting apparatus as a third embodiment of the present invention.

For example, although in the illustrated embodiment the operator inputs a thread-cut command in the sewing machine through the electric input device 56, it is possible to employ a mechanical connecting device which operatively connects a manually operable member to the feed-pitch adjuster 21 such that when the operable member is operated to a special position beyond a normal range, the adjuster 21 is inclined to the special angular position indicated at broken line in FIG. 9. For example, FIG. 12 shows a feed-pitch selecting member 80 which is manually operable within a normal range from 0 to 4 degrees in each of the forward and backward directions of the feeder 20 and which is also operable to a special position, i.e., thread-cutting position beyond the normal range. Similarly, FIG. 13 shows a feed-pitch selecting knob 90 which is manually turnable within a normal angular range in each of the forward and backward directions of the feeder 20 and which is also turnable to a special angular position, i.e., thread-cutting position beyond the normal range. However, these modified arrangements are somewhat more complex than that of the arrangement shown in FIGS. 1 to 11. The mechanical connecting device which operatively connects the manually operable member 80, 90 to the feed-pitch adjuster 21 may be provided by a known zero-max link mechanism as described previously.

In addition, while in the illustrated embodiment the thread-cutting switch lever 18 is rotated by the work-sheet feeder 20 which feeds the work sheet in the frontward and rearward directions of the sewing machine, it is possible to replace the feeder 20 with a movable member which is movable in the right and left directions of the sewing machine.

Although in the illustrated embodiment the thread-cutting switch lever 18 is rotated by the work-sheet feeder 20, it is possible to replace the feeder 20 with an embroidery frame (not shown) which supports a work sheet and is movable in a two-dimensional plane relative to the sewing needle 42.

Moreover, although in the illustrated embodiment the sewing needle 42 vertically reciprocates at a fixed position in the horizontal plane, the principle of the present invention is applied to a sewing machine including a sewing needle which is movable in the horizontal plane. In the latter case, the switch lever 18 may be rotated by a stitch forming device which moves the sewing needle in the horizontal plane.

It is to be understood that the present invention may be embodied with other changes, improvements, and modifications that may occur to those skilled in the art without departing from the scope and spirit of the invention defined in the appended claims.

What is claimed is:

1. A thread cutting apparatus comprising:

a pair of blades at least one of which is movable relative to the other blade to cut a thread;

a movable-blade actuating device including a thread-cutting control cam which is rotatable about an axis line, and a cam follower which is movable to an operative position thereof where said cam follower follows said control cam to move the movable blade to cut the thread, and an inoperative position thereof where the cam follower does not follow the control cam;

a biasing device which provides a biasing force to bias said cam follower toward said inoperative position;

a first movable member which is operatively engaged with said cam follower and which is movable to a first position thereof, and a second position thereof to move said cam follower to said operative position against the biasing force of said biasing device;

a second movable member which is movable between a third and a fourth position thereof and which engages, when being moved from said third position to said fourth position, said first movable member to move said first movable member to said second position; and a rotary member which is rotatable with said control cam and which holds said first movable member at said second position, against the biasing force of said biasing device, after said second movable member is moved from said fourth position to said third position, said rotary member permitting the first movable member to be moved to said first position, owing to the biasing force of the biasing device, after the control cam is rotated, the cam follower follows the rotation of the cam, and said movable blade is moved to cut the thread.

2. An apparatus according to claim 1, wherein said thread-cutting control cam and said rotary member are provided by a single rotatable member which is rotatable about said axis line.

3. An apparatus according to claim 1, wherein said thread-cutting control cam comprises a cylindrical cam having a cam groove formed in an outer circumferential surface thereof.

4. An apparatus according to claim 1, wherein said rotary member includes a cylindrical base portion whose center line coincides with said axis line, and an annular rib which projects concentrically from one end of said base portion and which has a recess extending in a circumferential direction of said annular rib, the rotary member holding said first movable member at said second position where a first portion of the first movable member is supported on an outer circumferential surface of the annular rib, said recess permitting the first movable member to be moved therethrough to said first position where said first portion of the first movable member is positioned inside said annular rib, owing to the biasing force of said biasing device.

5. An apparatus according to claim 1, for use with a sewing machine including an upper shaft, and a lower shaft for rotating a shuttle, wherein said thread-cutting control cam and said rotary member are fixed to the lower shaft of the sewing machine.

6. An apparatus according to claim 1, for use with a sewing machine including a feeding member for feeding a work sheet, wherein said second movable member comprises the feeding member, said third position of the second movable member being in a normal range in which said feeding member is movable to feed the work sheet during a stitch-forming operation of the sewing machine, said fourth position of the second movable member being outside said normal range.

7. An apparatus according to claim 1, wherein said first movable member comprises a rotatable member which is rotatable about an axis line thereof to each of said first and second positions.

8. An apparatus according to claim 7, wherein said rotatable member includes three arm portions which project radially from said axis line thereof and one of which is operatively engaged with said cam follower and the other two of which are engageable with said second movable member and said rotary member, respectively.

9. An apparatus according to claim 1, further comprising a support member which supports said cam follower such that the cam follower is movable along, and rotatable about, an axis line of said support member, wherein the cam follower is moved to said operative position along said axis line thereof and is rotated at the operative position about the axis line of the support member to move said movable blade to cut the thread.

10. An apparatus according to claim 1, further comprising a support member which supports said cam follower such that the cam follower is movable along, and rotatable about, an axis line of the support member which is substantially perpendicular to the axis line of said thread-cutting control cam, wherein the cam follower is moved to said operative position along said axis line of the support member and is rotated at the operative position about the axis line to move said movable blade to cut the thread, and wherein said first movable member comprises a rotatable member which is rotatable, to each of said first and second positions, about an axis line thereof which is substantially perpendicular to the axis line of said support member.

11. An apparatus according to claim 10, wherein said cam follower includes a pair of engagement portions which are spaced apart from each other in a direction parallel to the axis line of said support member, and wherein said rotatable member includes an engagement arm whose end portion is sandwiched between said pair of engagement portions of the cam follower such that the rotation of the rotatable member and the axial movement and rotation of the cam follower are permitted.

12. An apparatus according to claim 1, wherein said movable blade comprises a reciprocating blade which reciprocates along a straight line.

13. An apparatus according to claim 12, further comprising a support member which supports said cam follower such that the cam follower is movable along, and rotatable about, an axis line of said support member which is substantially perpendicular to the axis line of said thread-cutting control cam, wherein said movable-b lade actuating device comprises an intermediate lever which is rotatable about, and immovable along, an axis line thereof parallel to the axis line of the support member, and which is engaged with the cam follower and said movable blade, and wherein when the cam follower is rotated, said intermediate lever reciprocates the movable blade along said straight line.

14. An apparatus according to claim 1, wherein said movable-blade actuating device comprises a spring member which provides a biasing force to hold said movable blade at an inoperative position thereof and which permits the movable blade to be moved thereagainst by said thread-cutting cam and said cam follower so as to cut the thread.

15. An apparatus according to claim 1, further comprising an input device which is operable to input an electric thread-cutting command; and a control device which is operable, in response to said thread-cutting command, for moving said second movable member from said third position to said fourth position.

16. An apparatus according to claim 1, for use with a sewing machine including a feeding member for feeding a work sheet and a feeding-pitch adjusting member whose inclination angle is changeable within a normal range for adjusting a work-sheet feeding pitch of said feeding member, wherein the thread-cutting apparatus further comprises a control device which inclines the adjusting member by an angle beyond said normal range so that said second movable member is moved from said third position to said fourth position and the thread is cut by said pair of blades.

17. An apparatus according to claim 1, for use with a sewing machine including a feeding member for feeding a work sheet and a feeding-pitch adjusting member whose inclination angle is changeable within a normal range for adjusting a work-sheet feeding pitch of said feeding member, wherein the thread-cutting apparatus further comprises an input device which is operable to input an electric thread-cutting command; and a control device which is operable, in response to said thread-cutting command, for inclining the adjusting member by an angle beyond said normal range so that said second movable member is moved from said third position to said fourth position.

18. A thread cutting apparatus comprising:

a pair of blades at least one of which is movable relative to the other blade to cut a thread;

a movable-blade actuating device including a thread-cutting control cam which is rotatable about a first axis line, and a cam follower which is movable to an operative position thereof where said cam follower follows said control cam to move the movable blade to cut the thread, and an inoperative position thereof where the cam follower does not follow the control cam, said cam follower being movable along, and rotatable about, a second axis line, the cam follower being moved to said operative position along said second axis line and rotated at the operative position about the second axis line to move said movable blade to cut the thread;

a biasing device which provides a biasing force to bias said cam follower toward said inoperative position;

a first movable member which is operatively engaged with said cam follower and which is movable to a first position thereof, and a second position thereof to move said cam follower to said operative position against the biasing force of said biasing device;

a second movable member which is movable between a third and a fourth position thereof and which engages, when being moved from said third position to said fourth position, said first movable member to move said first movable member to said second position; and a holding device which holds said first movable member at said second position, against the biasing force of said biasing device, after said second movable member is moved from said fourth position to said third position, said holding device permitting the first movable member to be moved to said first position, owing to the biasing force of the biasing device, after the control cam is rotated, the cam follower follows the rotation of the cam, and said movable blade is moved to cut the thread.

19. An apparatus according to claim 18, further comprising a support member which supports said cam follower such that the cam follower is movable along, and rotatable about, said second axis line which is substantially perpendicular to said first axis line of said thread-cutting control cam.

20. An apparatus according to claim 18, wherein said movable-blade actuating device comprises an intermediate lever which is rotatable about, and immovable along, a third axis line parallel to said second axis line of said support member and which is engaged with said cam follower and said movable blade, and wherein when the cam follower is rotated, said intermediate lever moves the movable blade to cut the thread.

21. An apparatus according to claim 20, wherein one of said cam follower and said intermediate lever includes an engagement projection which projects substantially parallel to said second axis line and the other of the cam follower and the lever includes an engagement recess which is engaged with said engagement projection irrespective of which one of said operative and inoperative positions is taken by the cam follower, the rotation of the cam follower about said second axis line being transmitted to the intermediate lever via the engaged projection and recess.

22. A thread cutting apparatus for use with a sewing machine including an operable member which is operable within a normal range to control an operation of the sewing machine, the apparatus comprising:

a pair of blades at least one of which is movable relative to the other blade to cut a thread;

a movable-blade actuating device including a thread-cutting control cam which is rotatable about an axis line, and a cam follower which is movable to an operative position thereof where said cam follower follows said control cam to move the movable blade to cut the thread, and an inoperative position thereof where the cam follower does not follow the control cam; and a connecting device which operatively connects the operable member with said cam follower such that when the operable member is operated to a special position outside the normal range, the cam follower is moved to said operative position.

23. An apparatus according to claim 22, further comprising a biasing device which produces a biasing force to bias said cam follower toward said inoperative position; and a holding device which holds the cam follower at said operative position, against the biasing force of said biasing device, after the operable member is moved to a position within said normal range, said holding device permitting the cam follower to be moved to the inoperative position, owing to the biasing force of the biasing device, after the control cam is rotated, the cam follower follows the rotation of the cam, and said movable blade is moved to cut the thread.

* * * * *